US006626141B2

(12) United States Patent
Choi

(10) Patent No.: US 6,626,141 B2
(45) Date of Patent: Sep. 30, 2003

(54) ENGINE OIL CIRCULATION SYSTEM AND METHOD

(75) Inventor: Myung-Sik Choi, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/028,211

(22) Filed: Dec. 21, 2001

(65) Prior Publication Data

US 2002/0083915 A1 Jul. 4, 2002

(30) Foreign Application Priority Data

Dec. 30, 2000 (KR) ..... 2000-87041

(51) Int. Cl.[7] ..... F02B 33/04
(52) U.S. Cl. ..... 123/196 R
(58) Field of Search ..... 123/196 AB, 196 R, 123/73 AD, 196 M, 196 W; 184/6.8

(56) References Cited

U.S. PATENT DOCUMENTS

| | | | | |
|---|---|---|---|---|
| 5,339,776 A | | 8/1994 | Regueiro | |
| 5,592,395 A | * | 1/1997 | Braun et al. | 702/50 |
| 6,152,105 A | * | 11/2000 | Nishimura et al. | 123/339.11 |
| 6,161,515 A | | 12/2000 | Kopec | |
| 6,390,033 B1 | * | 5/2002 | Hartke et al. | 123/73 AD |

FOREIGN PATENT DOCUMENTS

| | | |
|---|---|---|
| JP | 09-088533 | 3/1997 |
| JP | 10037730 | 10/1998 |

OTHER PUBLICATIONS

Bosch, "Automotive Handbook," 4th Ed., Stuttgart: Robert Bosch GmbH, 1996, pp. 479–483, ISBN 1–56091–918–3.

* cited by examiner

*Primary Examiner*—Henry C. Yuen
*Assistant Examiner*—Hyder Ali
(74) *Attorney, Agent, or Firm*—Pennie & Edmonds LLP

(57) ABSTRACT

The present invention provides an engine oil circulation system comprising an oil temperature sensor installed in a lower part of an oil pan that detects temperature of oil stored in the oil pan; an oil pressure sensor that detects pressure of oil discharged from an oil pump; an engine state sensor that detects an engine speed and an engine load; an oil pressure relief valve that is installed in one side of the oil pump and bypasses oil to the oil pan when pressure of oil supplied from the oil pump is higher than a predetermined pressure, the predetermined pressure being a minimum pressure above which the engine operates properly; a solenoid valve that is installed in a bypass tube and controls oil bypass; and a solenoid valve controller that controls an operation of the solenoid valve by a predetermined control logic on the basis of data input from the above oil temperature, oil pressure and engine state sensors. It also provides an engine oil circulation control method using the above system comprising the steps of opening an idle speed actuator with a predetermined duty after an ignition switch is turned on, opening the solenoid valve, and maintaining the solenoid valve in an opened state.

14 Claims, 4 Drawing Sheets

ENGINE OIL CIRCULATION SYSTEM AND METHOD

BACKGROUND OF THE INVENTION

The present invention relates to a method and a system for controlling engine oil circulation, and more particularly, to a method and system for decreasing engine load in an initial operating period and properly controlling engine oil pressure such that pollutant emmisions are decreased.

The amount of pollutant emissions has become an important criterion for evaluating vehicle performance, and therefore it has become important to reduce pollutants in a vehicle. Pollutants exhausted from a vehicle include oxides of carbon such as carbon monoxide and carbon dioxide, as well as nitrogen oxides and hydrocarbons.

If fuel is incompletely burned, hydrocarbons are generated. Vehicles are now equipped with a catalytic converter, which is designed to reduce emissions from unacceptable to acceptable levels by re-burning the incompletely burned hydrocarbons. The catalytic converter only operates properly above a specific temperature (LOT: Lowest Operating Temperature), and because engine temperature is low in the initial operating period, there are many pollutant emissions at that time.

To reduce pollutant emissions in the initial operating period after startup, one may provide a lean air-fuel mixture or retard ignition timing. However, if the air-fuel mixture is lean or the ignition timing is retarded under high engine load conditions, the engine does not start or run properly. Therefore, reducing pollutant emissions in the initial operating period can be related to reducing engine load.

When the engine is operated, the engine drives many devices. An oil pump that provides lubricating oil to each part of the engine is one of the components driven by the engine, and therefore it increases engine load. In a conventional engine oil system, as shown in FIG. 1, the oil pump 13, driven by an engine crankshaft 12, generates oil pressure. The pressurized oil is provided into a main gallery through which it is provided to the engine. If the oil pressure is higher than a predetermined pressure, the oil pressure relief valve 15 is opened so that over-pressurized oil returns to an oil pan 11 via an oil return pipe 16. Therefore, the pressure of the oil pump is not maintained beyond the predetermined pressure. The oil pressure relief valve 15 is typically provided with a spring 17 and the predetermined pressure is determined by elastic power of the spring 17.

SUMMARY OF THE INVENTION

Thus, according to the present invention, a method and a system for controlling engine oil circulation, and decreasing pollutant emissions during an initial engine operating period are provided.

The system of the present invention thus may include a variety of sensors of engine performance parameters, a control unit receiving input from the sensors and plural valves controlled by the control unit to provide optimum oil circulation for increased engine performance and decreased pollutant emissions. More specifically, according to a preferred embodiment, an oil temperature sensor is disposed in a lower part of the oil pan to detect temperature of oil stored in the oil pan. An oil pressure sensor is disposed to detect oil pressure discharged from the oil pump. Also, an engine operation state sensor is provided to detect engine speed and engine load. Preferably an oil pressure relief valve and a solenoid valve are provided. The oil pressure relief valve is disposed in one side of the oil pump and bypasses oil to the oil pan when oil pressure supplied from the oil pump is higher than a predetermined pressure. The solenoid valve is disposed in the oil return pipe and controls oil bypass. As mentioned, a control unit preferably controls the operation of the solenoid valve based on data from the above sensors. The predetermined pressure of the oil pressure relief valve is set as a minimum pressure above which the engine works properly.

In a preferred embodiment, the control unit controls the solenoid valve on the basis of the oil temperature, the oil pressure and the engine operation state with a given control logic. The control logic prefereably includes a step of fully opening the solenoid valve if the starter motor operates until an engine speed is over a predetermined speed.

In a further aspect of the present invention an engine oil circulation control method is provided. According to a preferred enbodiment, the method includes opening an idle speed actuator (ISA) with a predetermined duty ratio if the ignition switch is turned on, opening the solenoid valve fully, and maintaining the solenoid valve to be fully open until the engine speed is higher than a predetermined speed. Furthermore, after the step of maintaining the solenoid valve to be fully open, the control method can further comprise a step of entering into an idle mode control where the solenoid valve is controlled on the basis of the oil temperature, the oil pressure and the engine operation state.

Preferably, the idle mode control comprises a number of control steps as follows:

The ISA is controlled by an air flow rate calculated by a given air flow rate function.

The solenoid valve is controlled by a duty ratio determined by a function of engine oil temperature, engine speed and engine load.

The air-fuel ratio is controlled by a given air-fuel ratio function such that the air-fuel ratio is high, but within a range where a fluctuation of engine speed can be regulated by ignition timing control.

The ignition timing is controlled by a given ignition timing function so as to eliminate fluctuation of engine speed in the case there is a fluctuation of engine speed. In addition to these control steps, a specific time (t(i)) is measured when the engine speed becomes higher than a predetermined idle speed.

Then, based on the gear-shift mode, the procedure is advanced to a "D" mode control step if a gear-shift mode is neither an "N" mode (neutral) nor a "P" mode (park), when the engine speed is higher than the predetermined idle speed.

If in either an "N" mode or a "P" mode, then it is determined whether an oxygen sensor temperature (To2) is lower than a predetermined Lambda feedback control temperature (TLOT), or a time elapsed after entering into an idle mode (t(i)-t(1)) is less than a predetermined time (ts(Tc)) determined by a function of a coolant temperature Tc, and then if the condition is not satisfied, the procedure is advanced to an ISA control step. Further steps include setting an ISA position as P1 in the case the oxygen sensor temperature (To2) is lower than the predetermined Lambda feed-back control temperature, and the time elapsed after entering into the idle mode (t(i)-t(1)) is less than the predetermined time (ts(Tc)) determined by a function of a coolant temperature, and determining whether a difference between a current and an immediate past engine speed is larger than a predetermined value, and if the difference is not larger than the predetermined value, advancing to the step of controlling the ignition timing, and otherwise advancing to the step of controlling the air-fuel ratio.

DETAILED DESCRIPTION OF THE PREFERRED EMBODIMENTS

Hereinafter, a preferred embodiment of the present invention will be described in detail with reference to the accompanying drawings.

Figure 1:
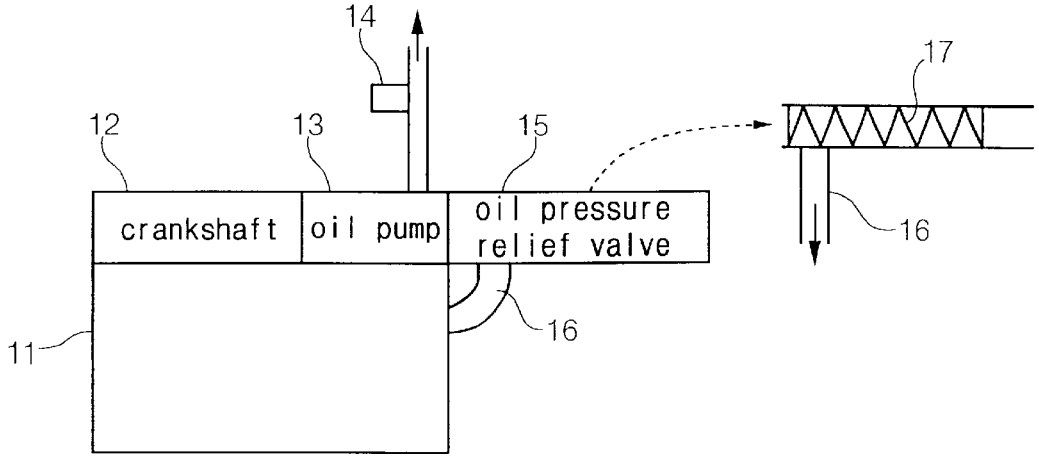
Fig. 1 (Prior Art)
FIG. 1 shows structural elements of a conventional engine oil providing system.
Figure 2:
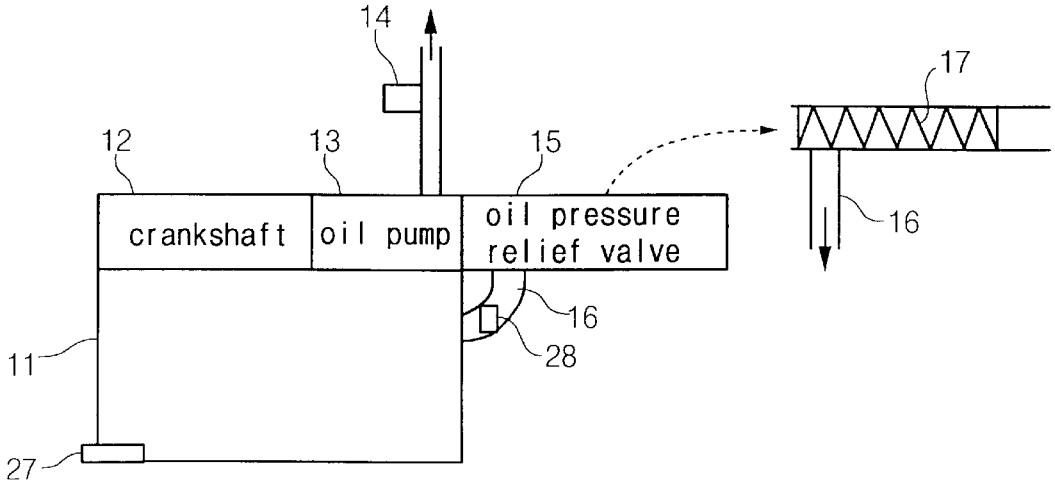
FIG. 2 shows structural elements of an engine oil circulation system according to a preferred embodiment of the present invention.
Figure 3:
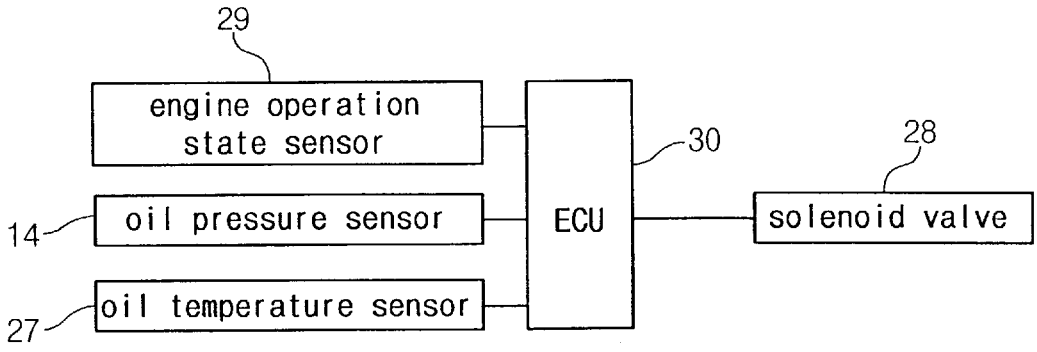
FIG. 3 is a block diagram of an oil circulation control system according to the present invention.

An engine oil circulation system according to a preferred embodiment of the present invention, as shown in FIGS. 2 and 3, comprises a variety of sensors and valves communicating with an electronic control unit (ECU). For example, an oil temperature sensor 27 is disposed in a lower part of an oil pan 11 to detect temperature of oil stored in the oil pan. An oil pressure sensor 14 is disposed to detect oil pressure discharged from an oil pump 13. An engine operation state sensor 29 is disposed to detect engine speed and engine load. An oil pressure relief valve 15 is installed in one side of the oil pump 13 and bypasses oil to the oil pan when oil pressure supplied from the oil pump is higher than a predetermined pressure. A solenoid valve 28 is installed in an oil return tube 16 and controls oil bypass and ECU 30 controls operation of the solenoid valve on the basis of the data input from the above sensors 27, 14 and 29.

A predetermined oil pressure above which the oil pressure relief valve 15 bypasses oil to the oil pan 11 is set as a value lower than a predetermined pressure of typically used in the prior art. Preferably, the predetermined oil pressure is set as a minimum oil pressure above which the engine operates properly, and by way of example, the predetermined oil pressure can be set at approximately 3 bar.

As will be understood by persons skilled in the art, the engine state sensor 29 can include a crank angle sensor, and to detect engine load it can also include a throttle position sensor (TPS).

The ECU 30 controls the solenoid valve 28 on the basis of oil temperature, oil pressure and engine operation state, and it controls the solenoid valve by performing an engine oil circulation control method according to a preferred embodiment of the present invention as will be described later. Prefereably, the ECU 30 comprises a microprocessor operated by a given program, and the oil circulation control method according to the preferred embodiment of the present invention can be programmed to be performed by the microprocessor. Alternatively, a controlled employing a predetermined control logic or an appropriate circuitry may be devised by a person of ordinary skill in the art.

Figure 4:
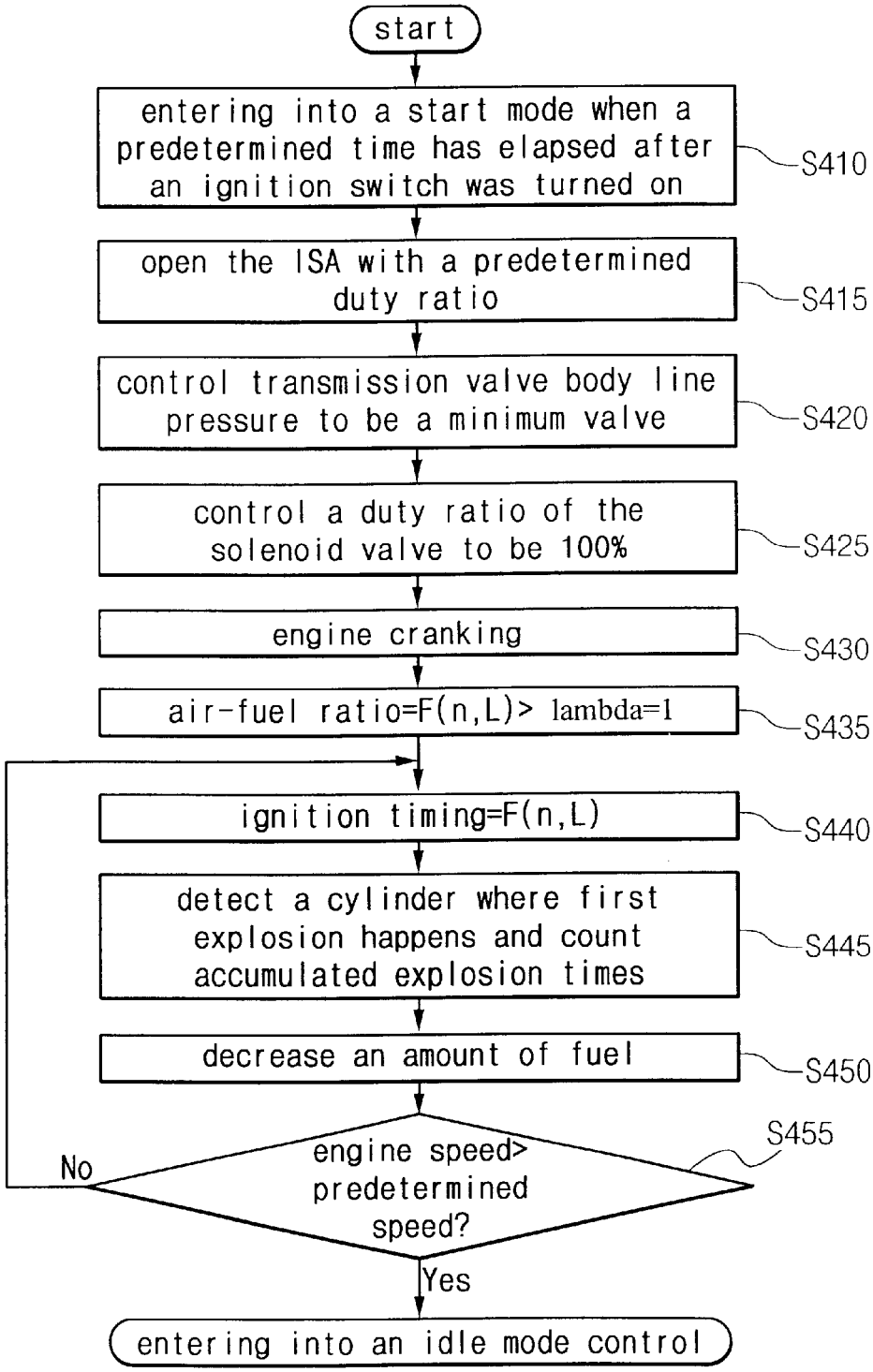
FIG. 4 is a flow chart showing an engine oil circulation control method in according to the present invention in the engine start state.

As shown in FIG. 4, when a predetermined time has elapsed after an ignition switch is turned on, the procedure enters into a start mode (S410) at which point an idle speed actuator (hereinafter called 'ISA') is opened with a predetermined duty ratio (S415).

Then, transmission valve body line pressure is regulated to be a minimum value (S420).

Steps S415 and S420 are the same as engine control methods in initial engine operation as in the prior art, and therefore are understood by persons skilled in the art. By minimizing loads of the engine and transmission, the engine can be started under a lean air-fuel mixture.

Then, the ECU 30 controls a duty ratio of the solenoid valve 28 to be 100% such that all oil returned to the oil pressure relief valve 15 is bypassed to the oil pan 11 (S425).

In the prior art, the oil pressure relief valve depends only on an elastic force of a spring, but in a preferred embodiment of the present invention the oil pressure relief valve depends on both an elastic power of a spring and a solenoid valve.

Then, when the engine is cranked by operation of a starter motor (S430), the ECU 30 sets an air-fuel ratio to be higher than that of a state of lambda='1' (S435). The state at lambda='1' is a theoretical air-fuel ratio state, and if lambda is higher than '1', the air-fuel ratio is higher than the theoretical air-fuel ratio, that is, the air-fuel mixture is more lean.

In step S425, when the oil pressure is increased excessively owing to high oil viscosity, the oil pressure is bypassed to the oil pan by the oil pressure relief valve 15 where a predetermined pressure is set as a minimum pressure.

Therefore, engine load caused by the oil pump is decreased, and thus the engine works more smoothly under a state of lean air-fuel mixture.

After controlling the air-fuel ratio, ignition timing is retarded (S440). Here, the ignition timing is controlled to have a maximum retarding angle in which the engine is properly operated under the engine load, as decreased by the opening of the solenoid valve. By way of example, the maximum retarding angle can be set as 8° ATDC (after top dead center).

Then, the first cylinder to fire is detected, and an accumulated number of firing times is counted (S445).

If the angular acceleration of a crankshaft of the first fired cylinder is higher than a predetermined acceleration, it is determined that the first firing occurred in that cylinder, and the accumulated number of firing times can be determined by counting the number of times the first cylinder fired.

Then, the amount of fuel is controlled to be decreased on the basis of the acquired number of firing times (S450).

The fuel-decreasing control is based on a wetting value of the corresponding cylinder, and the wetting value is obtained by summing the number of firing times of a corresponding cylinder, the number of firing times after the first firing, manifold pressure, coolant temperature, and atmospheric temperature.

The manifold pressure, the coolant temperature and the atmospheric temperature are converged into values that are suitable for the above calculation with converging constants. These values are considered because they have effects on fuel evaporation.

After fuel-decreasing control is performed, it is determined whether the engine speed is higher than a predetermined speed (S455), which is set as a speed at which stable idle control is possible. By way of example the predetermined speed may be set at approximately 1200 rpm. If the engine speed is not higher than the predetermined speed, the procedure returns to step S440. Therefore, steps S440 to S455 are repeatedly performed until the engine speed is higher than the predetermined speed.

In step S455, if the engine speed is higher than the predetermined speed, the procedure enters into an idle mode control, and the solenoid valve 28 is controlled by a function that is set to be calculated by the engine speed, the engine load and the oil pressure.

Figure 5:
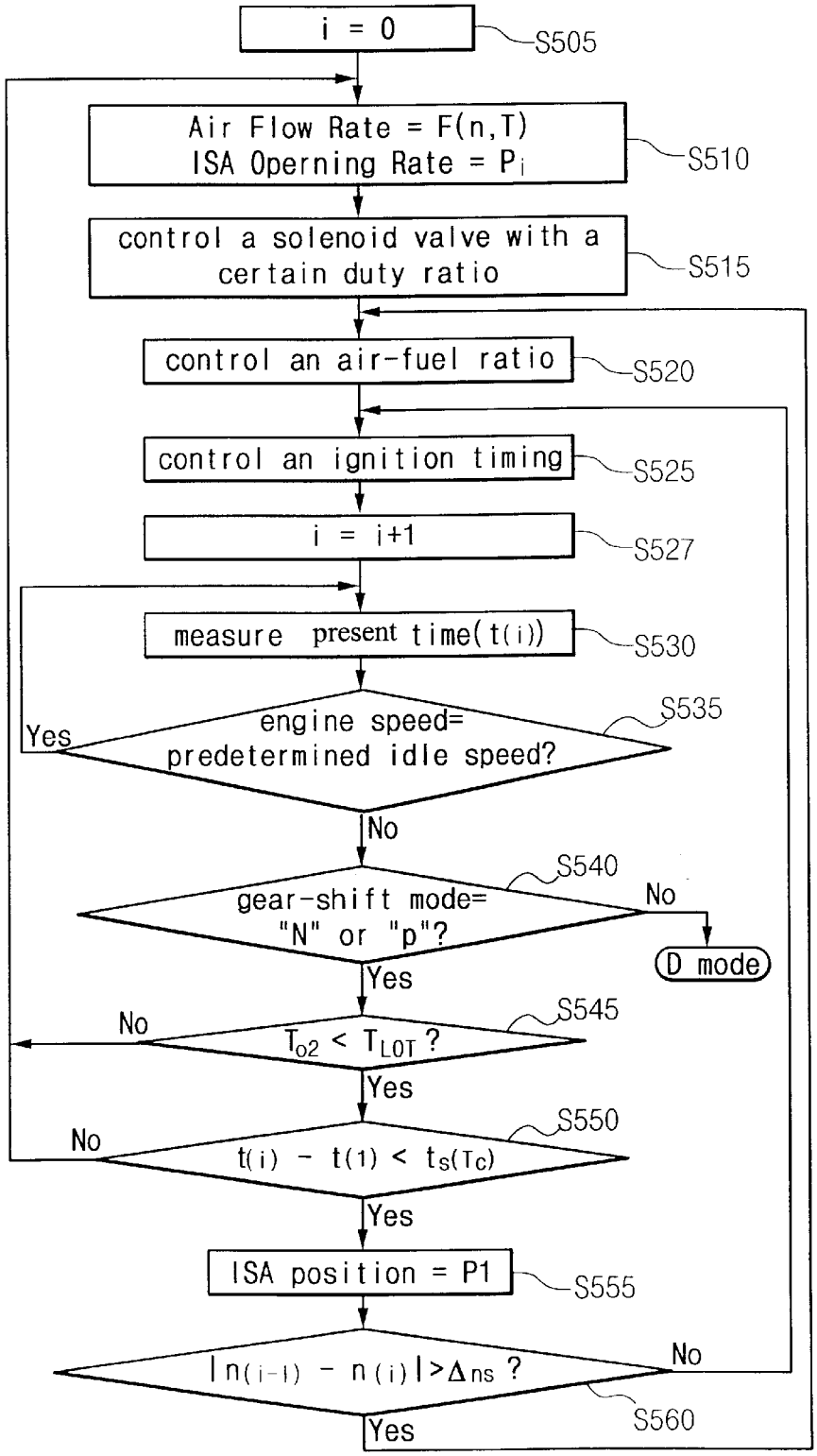
FIG. 5 is a flow chart showing an engine oil circulation control method according to the present invention in the engine idle state.

As shown in FIG. 5, if the idle mode control starts, a variable "i" is initially set as "0" (S505), and then the ISA is controlled with an opening rate Pi obtained by an air flow rate that is calculated from a predetermined air flow rate function (S510).

After step S510, the solenoid valve 28 is controlled with a certain duty ratio (S515). The certain duty ratio is determined by a function F(Toil, n, L) that is set to be calculated by the engine oil temperature (Toil), the engine speed (n) and the engine load (L).

The air-fuel ratio is then controlled by a certain air-fuel ratio function (S520), and the ignition timing is controlled by a certain ignition timing function (S525). In step S520, the air-fuel ratio is controlled to be lean, and it is also controlled to be a value within a range whereby a fluctuation of the engine speed can be controlled by the ignition timing. If there is a fluctuation of the engine speed, the ignition timing control is performed such that the fluctuation of the engine speed is eliminated.

Then '1' is added to the variable "i" (S527), the present time (t(i)) is measured (S530), and it is determined whether the engine speed is equal to a predetermined idle speed (S535). At this time, if the engine speed is equal to the predetermined idle speed, the procedure returns to step S530, and therefore the time when the engine speed is higher than the predetermined idle speed can be measured.

In step S535, if the engine speed is not the predetermined idle speed, the procedure is advanced to step S540, where determination is made as to whether a gear-shift mode is an "N" mode or a "P" mode. If the gear-shift mode is neither the "N" mode nor the "P" mode, the procedure is advanced to a "D" mode control step.

In step S540, if the gear-shift mode is the "N" mode or the "P" mode, the procedure is advanced to step S545, where determination is made as to whether an oxygen sensor temperature (To2) is lower than a lambda feedback temperature (TLOT) below which the lambda feedback control cannot be performed.

In step S545, if the oxygen sensor temperature (To2) is not lower than the lambda feedback temperature (TLOT), the procedure returns to step S510. If the oxygen sensor temperature (To2) is lower than the lambda feedback temperature (TLOT), the procedure is advanced to step S550 where determination is made as to whether an elapsed time after entering the idle mode (t(i)-t(1)) is less than a predetermined time (ts(Tc)) determined by a function of a coolant temperature (Tc).

In step S550, if the elapsed time after entering the idle mode (t(i)-t(1)) is not less than the predetermined time (ts(Tc)), the procedure returns to step S510.

Therefore, if the oxygen sensor temperature (To2) is not lower than the lambda feedback temperature (TLOT) in step S545, or if the elapsed time after entering the idle mode is not less than the predetermined time in step S550, the procedure returns to step S510, and thereby the solenoid valve control is performed repeatedly.

In step S550, if the elapsed time after entering the idle mode (t(i)-t(1)) is less than the predetermined time (ts(Tc)), the procedure is advanced to step S555, where an ISA position is controlled to be a predetermined value P1.

The value P1 is set as an arbitrary value that is proximate to 100%, and by way of example it may be set as 100%. That is, for a short time after entering idle state, the ISA control value is controlled to be proximate to 100%.

Then, it is determined whether a difference between a current and an immediate past engine speed |n(i-1)−n(i)| is larger than a predetermined value ⓧns (S560).

The predetermined value ⓧns is set as a value at which the fluctuation of the engine speed can be eliminated by the ignition timing control.

In step S560, if the difference between the engine speeds |n(i-1)−n(i)| is not larger than the predetermined value ⓧns, the procedure returns to step S525, and if the difference between the engine speeds |n(i-1)−n(i)| is larger than the predetermined value ⓧns, the procedure returns to step S520.

Therefore, if the difference between the engine speeds can be controlled only by the ignition timing when the lambda feedback is impossible and the elapsed time is less than the predetermined time, the procedure returns to step S525 of controlling the ignition timing, and if the difference between the engine speeds cannot be controlled only by the ignition timing when the lambda feedback is impossible and the elapsed time is less than the predetermined time, it is determined that the air-fuel mixture is too lean, and the procedure returns to step S520 of controlling the air-fuel ratio such that the difference between the engine speeds can be controlled only by the ignition timing control.

While the present invention has been described in detail with reference to the preferred embodiment, those skilled in the art will appreciate that various modifications and substitutions can be made thereto without departing from the sprit and scope of the present invention as set forth in the appended claims.

According to the preferred embodiment of the present invention, by reducing the engine load caused by the oil pump in engine starting, the engine can be smoothly started, and also because the engine load is reduced, the startability of the engine is maintained even when the air-fuel mixture is lean and the ignition timing is retarded, and the pollutant emissions can be reduced in the early state of engine running.

Furthermore, when the engine is idling, the solenoid valve is controlled on the basis of the engine speed, the oil temperature and the load so that the engine oil pressure is maintained to be optimal, and thereby the air-fuel ratio control and the ignition timing control are possible, and therefore fuel mileage can be increased.

What is claimed is:

1. An engine oil circulation system, comprising:

an oil temperature sensor disposed in a lower part of an oil pan that detects temperature of oil stored in the oil pan;

an oil pressure sensor that detects oil pressure discharged from an oil pump;

an engine state sensor that detects engine speed and engine load;

an oil pressure relief valve cooperating with oil pump to bypass oil to the oil pan when oil pressure supplied from the oil pump is higher than a predetermined pressure;

a solenoid valve disposed to control oil bypass; and a control unit that controls operation of the solenoid valve by a predetermined control logic on the basis of data input from said oil temperature, oil pressure and engine state sensors, in order to bypass oil to the oil pan during engine startup.

2. The engine oil circulation system of claim 1, wherein said predetermined pressure is set as a minimum pressure above which the engine operates properly.

3. The engine oil circulation system of claim 1, wherein the solenoid valve is disposed in an oil return tube communicating with said relief valve and oil pan.

4. The engine oil circulation system of claim 1, wherein said control unit includes a microprocessor for executing said predetermined control logic.

5. The engine oil circulation system of claim 1, wherein the predetermined control logic of the control unit comprises instructions for opening fully the solenoid valve until engine speed is higher than a predetermined speed after a starter motor is operated.

6. The engine oil circulation system of claim 4, wherein the predetermined control logic comprises:

(a) instructions for opening an idle speed actuator with a predetermined duty ratio after an ignition switch is turned on;

(b) instructions for opening the solenoid valve fully; and (c) instructions for maintaining the solenoid valve at the open state until the engine speed is higher than a predetermined speed.

7. The engine oil circulation system of claim 6, wherein the control logic further comprises an instruction for entering into an idle mode control while controlling the solenoid valve on the basis of the oil temperature, the oil pressure and the engine state by a given control logic after step (c).

8. The engine oil circulation system of claim 7, wherein the idle mode control comprises:

(a) instructions for controlling an ISA by an air flow rate that is calculated by a predetermined air flow rate function;

(b) instructions for controlling the solenoid valve with a duty ratio that is calculated by a function of engine oil temperature, engine speed and engine load;

(c) instructions for controlling an air-fuel ratio such that an air-fuel mixture is lean and is a value within a range where a fluctuation of an engine speed can be controlled by ignition timing control;

(d) instructions for controlling the ignition timing such that a fluctuation of engine speed is eliminated;

(e) instructions for measuring from a specific time until the engine speed is higher than a predetermined idle speed;

(f) instructions for determining whether a gear-shift mode is an "N" mode or a "P" mode if the engine speed is higher than the predetermined idle speed, and performing a "D" mode control if the gear-shift mode is neither the "N" mode nor the "P" mode;

(g) instructions for determining, if the gear-shift mode is the "N" mode or the "P" mode, whether an oxygen sensor temperature is lower than a lambda feedback control temperature, or if an elapsed time after entering the idle mode is less than a predetermined time determined by a function of a coolant temperature, and then if the oxygen sensor temperature is not lower than the lambda feedback temperature or if the elapsed time after entering the idle mode is not less than the predetermined time, returning to step (a);

(h) instructions for controlling the ISA position to be a predetermined value P1 if the oxygen sensor temperature is lower than the lambda feedback temperature and the elapsed time after entering the idle mode is less than the predetermined time; and (i) instructions for determining whether a difference between a current and an immediate past engine speed is larger than a predetermined value, and if the difference between the engine speeds is not larger than the predetermined value, returning to step (d), and if the difference between the engine speeds is larger than the predetermined value, returning to step (c).

9. A method for controlling engine oil circulation in a vehicle including an oil circulation system having an oil temperature sensor, an oil pressing sensor, an engine state sensor that detects engine speed and engine load, an oil pressure relief valve to direct oil through a return tube to an oil pan in an oil over pressurization condition, and a solenoid valve to control oil flow through the return tube, said method comprising:

opening an idle speed actuator with a predetermined duty ratio after an ignition switch is turned on;

opening the solenoid valve fully; and maintaining the solenoid valve fully open until engine speed is higher than a predetermined speed.

10. The method of claim 9, wherein controlling the idle mode comprises:

(a) controlling the idle speed actuator by an air flow rate that is calculated by a predetermined air flow rate function;

(b) controlling the solenoid valve with a duty ratio that is calculated by a function of engine oil temperature, engine speed and engine load;

(c) setting the engine-air-fuel mixture to lean at a value within a range where fluctuation of engine speed can be controlled by ignition time control;

(d) controlling the ignition timing such that fluctuation of engine speed is eliminated; and (e) measuring from a specific time until the engine speed is higher than a predetermined idle speed.

11. The method of claim 10, further comprising determining whether the engine transmission is neutral or park, and if so, then:

(f) determining whether an oxygen sensor temperature is lower than a lambda feedback control temperature, or if an elapsed time after entering the idle mode is less than a predetermined time determined by a function of a coolant temperature, and then if the oxygen sensor temperature is not lower than the lambda feedback temperature or if the elapsed time after entering the idle mode is not less than the predetermined time, returning to said step (a);

(g) controlling the idle speed actuator position to a predetermined value P1 if the oxygen sensor temperature is lower than the lambda feedback temperature and the elapsed time after entering the idle mode is less than the predetermined time; and (h) determining whether a difference between a current and an immediate past engine speed is large than a predetermined value, and if the difference between the engine speeds is not larger than the predetermined value, returning to step (d), and if the difference between the engine speeds is larger than the predetermined value, returning to step (c).

12. An engine oil circulation system, comprising:

an oil temperature sensor disposed in a lower part of an oil pan that detects temperature of oil stored in the oil pan;

an oil pressure sensor that detects oil pressure discharged from an oil pump;

an engine state sensor that detects engine speed and engine load;

an oil pressure relief valve cooperating with oil pump to bypass oil to the oil pan when oil pressure supplied from the oil pump is higher than a predetermined pressure;

a solenoid valve disposed to control oil bypass; and a control unit that controls operation of the solenoid on the basis of data input from said oil temperature, oil pressure and engine state sensors, wherein said control unit executes instructions for fully opening said solenoid valve at startup until engine speed is higher than a predetermined speed.

13. A method for controlling engine oil circulation, comprising:

circulating lubricating oil through a circulation system;

bypassing oil around the engine to an oil pan initially at ignition; and ending said bypassing and directing oil through the engine reaches a predetermined operating speed.

14. The method of claim 13, wherein said bypassing comprises opening a solenoid valve on said oil circulation system.

* * * * *